US006767126B2

(12) United States Patent
Miller

(10) Patent No.: US 6,767,126 B2
(45) Date of Patent: Jul. 27, 2004

(54) FLUID MIXER FOR ACCOMMODATING CONTAINERS OF VARYING SIZES

(75) Inventor: William A. Miller, Buffalo Grove, IL (US)

(73) Assignee: Fluid Management, Inc., Wheeling, IL (US)

( * ) Notice: Subject to any disclaimer, the term of this patent is extended or adjusted under 35 U.S.C. 154(b) by 24 days.

(21) Appl. No.: 10/100,973

(22) Filed: Mar. 19, 2002

(65) Prior Publication Data

US 2003/0179646 A1 Sep. 25, 2003

(51) Int. Cl.[7] ..... B01F 9/02
(52) U.S. Cl. ..... 366/217
(58) Field of Search ..... 366/217, 219; 494/19, 33

(56) References Cited

U.S. PATENT DOCUMENTS 1,908,561 A 5/1933 Schletz et al.
2,022,527 A * 11/1935 Schletz ..... 366/211
2,599,833 A 6/1952 Holmlund
2,894,309 A 7/1959 Brzowski
3,181,841 A 5/1965 Boehm
3,199,775 A * 8/1965 Drucker ..... 494/19
3,265,366 A 8/1966 Warner
3,542,344 A 11/1970 Oberhauser
3,682,374 A * 8/1972 Joyce ..... 494/33
3,706,443 A 12/1972 Oberhauser
3,880,408 A 4/1975 Karjalainen
3,894,723 A 7/1975 Sanders et al.
4,235,553 A 11/1980 Gall
4,497,581 A * 2/1985 Miller ..... 366/208
4,874,358 A * 10/1989 Brimhall et al. ..... 494/37
4,235,553 A 4/1991 Gall

* cited by examiner

*Primary Examiner*—Terry K. Cecil
(74) *Attorney, Agent, or Firm*—Marshall, Gerstein & Borun LLP

(57) ABSTRACT

A mixer for fluid material in containers of varying sizes rotates the material continuously in one direction about a first axis and simultaneously about a second axis which is non-perpendicular to the first axis, the first axis rotating about the second axis. The mixer rotates the container simultaneously about the two axes. Desirable top to bottom circulation of the fluid within the container is achieved. The container support is capable of accommodating containers of varying lengths and diameters.

15 Claims, 1 Drawing Sheet

FLUID MIXER FOR ACCOMMODATING CONTAINERS OF VARYING SIZES

TECHNICAL FIELD

A machine for mixing fluid material, and more particularly, a machine for agitating and mixing fluid material in containers of varying sizes is disclosed.

BACKGROUND

Mixing of various materials, for example paint, has heretofore been affected by manually mixing or agitating the material, such as by stirring or shaking. For example, U.S. Pat. No. 3,894,723 is directed to a mechanical agitator, while U.S. Pat. Nos. 1,908,561 and 3,265,366 disclose paint shaking devices. The mixing action is relatively slow and inefficient in these devices. Material shaking devices, such as paint shakers, require substantial mechanical structure and a heavy base or anchoring since vibration is a major problem. Due to vibration and the force of the material on the lid of the container, cumbersome clamping apparatus must be employed to tightly retain the lid in position during the shaking operation. U.S. Pat. Nos. 2,599,833 and 2,894,309 disclose clamping apparatuses for use with containers in shaking devices.

Others achieve mixing by accelerating material in a container first in one direction and then in a second opposite direction to achieve mixing by the combination of shear forces and the creation and destruction of a vortex in the material. A mixer of this type is shown in U.S. Pat. No. 3,542,344. While a mixer of this type reduces the problems of vibration and eliminates the necessity to clamp the lid on the container, substantial power and braking apparatus are required to effect the acceleration and reversal of the material in the container.

Another type of mixer spins the container in one direction and oscillates the container at the same time. An example of this type of device is disclosed in U.S. Pat. No. 3,181,841. This type of device also requires substantial mechanical structure, disadvantageously causes vibration and requires clamping of the lid or cover of the container.

Still another type of mixing apparatus simultaneously spins a container of material about two perpendicular axes. U.S. Pat. No. 3,880,408 discloses a device in which the container is rotated continuously about the two axis, whereas U.S. Pat. No. 3,706,443 discloses apparatus which rotates the container continuously about one axis but only rocks about a second, perpendicular axis by gyroscopic forces due to imbalance in the system. While the resulting mixing action is relatively rapid, considerable mechanical structure is required and, because of the vibration, the lid must be securely clamped to the container.

Another type of mixer which has become a standard in the paint industry is disclosed in U.S. Pat. No. 4,235,553. The mixer simultaneously rotates the fluid container in one direction about a first axis and simultaneously rotates the container about a second axis which is non-perpendicular to the first axis. The rotation of the container about two different, non-perpendicular axes results in efficient bottom circulation of the fluid material within the container.

One shortcoming of all of the above-referenced devices is the supporting structure for the fluid container. Specifically, the supporting structures are fixed in size and are unable to accommodate longer than normal containers or containers of a smaller diameter.

Accordingly, there is a need for an improved mixer for fluid materials and suspensions which is capable of accommodating containers of differing lengths and diameters.

SUMMARY OF THE DISCLOSURE

In satisfaction of the aforenoted needs, an apparatus for mixing flowable material contained within a container is disclosed. The apparatus features a container holder that comprises a cylindrical sleeve with an open top and bottom. The cylindrical sleeve comprises an inner wall comprising a plurality of radially inwardly extending fingers for frictionally engaging containers of varying lengths and diameters.

In an embodiment, the apparatus comprises a motor coupled to an arm. The motor imparts rotational movement to the arm about a first axis. The arm is coupled to a first gear for imparting rotational movement to the first gear. The arm is also coupled to a container holder for imparting rotational movement to the container holder. The first gear is enmeshed with a second stationary gear. The arm and first gear rotate about the second stationary gear. The first gear is coupled to a shaft for imparting rotational movement to the shaft. The shaft is coupled to a third beveled gear for imparting rotational movement to the third beveled gear. The third beveled gear is enmeshed with a fourth beveled gear for imparting rotational movement to the fourth beveled gear. The fourth beveled gear is coupled to the container holder for imparting rotational movement to the container holder about a second axis that is not parallel or perpendicular the first axis. The container holder comprises a cylindrical sleeve with an open top and bottom. The cylindrical sleeve comprises an inner wall comprising a plurality of radially inwardly extending fingers for frictionally engaging the container.

In a refinement, the arm comprises a bracket that surrounds the container holder and houses the fourth beveled gear. The fourth beveled gear supports the container holder within the bracket while the fourth beveled gear and container rotate within the bracket about the second axis.

In a further refinement, the container holder is fabricated from an elastomer, such as a rubber of other polymeric material.

In another refinement, the motor is coupled to the arm with a belt and pulley connection. More specifically, the motor may be coupled to a drive shaft that is coupled to a first pulley. The first pulley is coupled to a second pulley by a belt and the second pulley is connected to the arm for imparting rotational movement to the arm about the first axis.

In another refinement, the arm comprises a housing and the first gear, shaft, third beveled gear and fourth beveled gear are at least substantially contained within the housing of the arm.

It should be understood that the drawings are not necessarily to scale and that the embodiments are sometimes illustrated by diagrammatic representations and fragmentary views. In certain instances, details which are not necessary for an understanding of the disclosed apparatuses or which render other details difficult to perceive may have been omitted. It should be understood, of course, that the disclosure is not necessarily limited to the particular embodiments illustrated herein.

DETAILED DESCRIPTION OF THE PRESENTLY PREFERRED EMBODIMENTS

Figure 1:
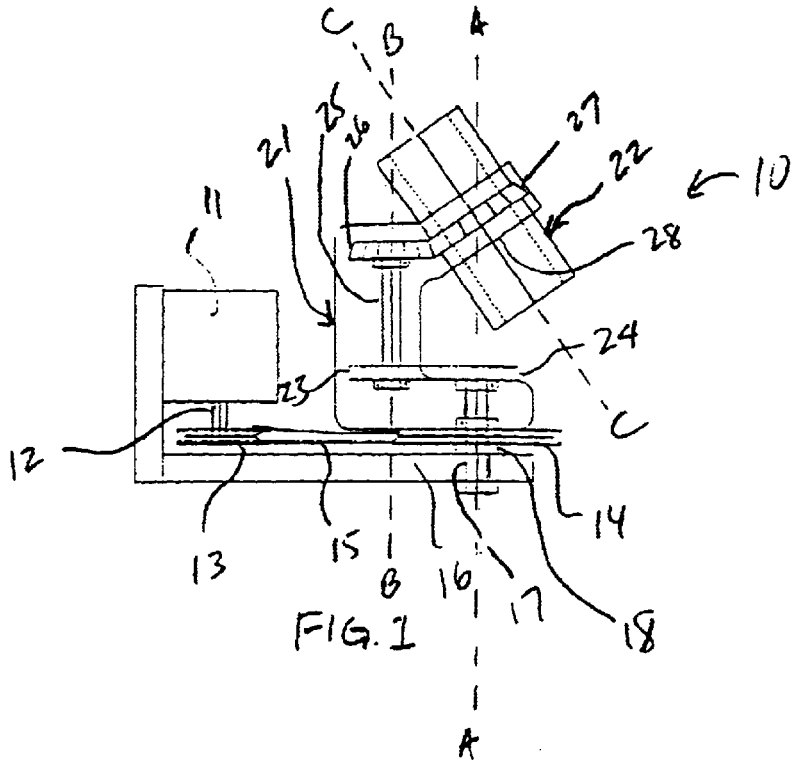
FIG. 1 is a side schematic view of a disclosed mixing apparatus.

A mixing apparatus 10 is illustrated in FIG. 1. The apparatus 10 includes a motor 11 coupled to a drive shaft 12. The drive shaft 12, in turn, is coupled to a pulley 13. The pulley 13 is connected to a pulley 14 by a belt 15. The pulley 14 is supported above the base 16 by a shaft 17 and spacer 18. The pulley 14 is connected to an arm 21 by way of the shaft 17. Thus, rotational movement imparted to the drive shaft 12 is translated through the pulleys 13, 14, belt 15 and shaft 17 to the arm 21. As a result, the arm 21 rotates about a first axis A.

As shown in FIG. 1, the arm 21 is coupled to a container holder 22 which, in turn, as discussed below, can support a container of fluid or other flowable material. Therefore, in operation, the container, by way of the arm 21, also rotates about the axis A.

Additional rotational movement is provided by the gear system as follows. The arm 21 is coupled to the gear 23 which, in turn, is enmeshed with a fixed gear 24. As the arm 21 rotates about the axis A and the fixed gear 24, the gear 23, which is enmeshed with the fixed gear 24, also rotates about the axis B. The gear 23 is connected to a shaft 25 which, in turn, is connected to the beveled gear 26. Thus, as the arm 21 rotates about the axis A and fixed gear 24, rotational movement about the axis B is imparted to the gear 23, shaft 25 and beveled gear 26.

The beveled gear 26 is enmeshed with another beveled gear 27. The beveled gear 27 is accommodated within a bracket 28 of the arm 21. The beveled gear 27 rotates within the bracket 28 about the axis C. The beveled gear 27 is also coupled or connected to the container holder 22. Thus, rotation of the beveled gear 28 about the axis C results in rotation of the container holder 28 about the axis C.

Figure 2:
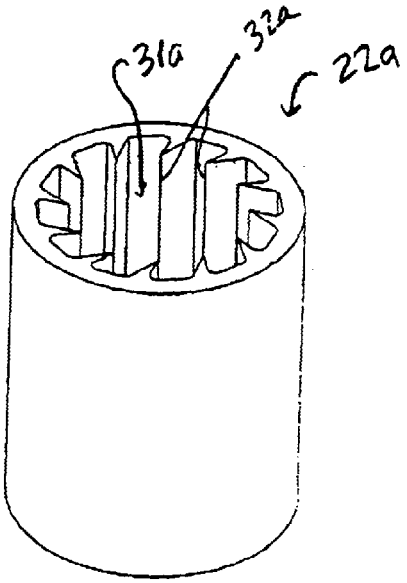
FIG. 2 is a perspective view of a container holder used in a mixing apparatus of FIG. 1.
Figure 3:
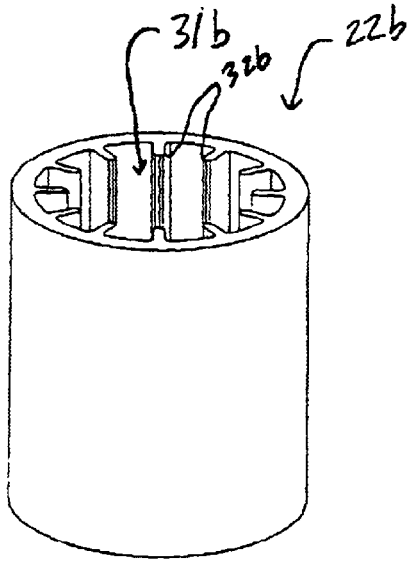
FIG. 3 is a perspective view of another container holder used in the mixing apparatus of FIG. 1.

One advantage of the apparatus 10 shown in FIG. 1 lies in the container holder 22, two versions of which, 22*a* and 22*b* are illustrated in FIGS. 2 and 3. Specifically, the container holders 22*a* and 22*b* are cylindrical in configuration with open tops 31*a*, 31*b* and open bottoms (not shown). Thus, a container may be disposed within the container holder 22*a*, 22*b* without regard to the length of the container. Accordingly, the container holders 22*a*, 22*b* can accommodate containers of varying lengths or heights.

Another advantage to the container holders 22*a*, 22*b* lies in the inwardly extending fingers shown at 32*a*, 32*b*. These inwardly extending fingers 32*a*, 32*b* frictionally engage a cylindrical container and enable the container holders 22*a*, 22*b* to accommodate containers of varying diameters. Thus, the container holders 22*a*, 22*b* can accommodate containers of varying heights or lengths and varying diameters as well.

The ability of the container holders 22*a*, 22*b* to accommodate containers of varying lengths or heights and diameters is important. Specifically, in the paint industry, paint containers are typically provided in a standard size. However, the apparatus 10 can be used in other industries where container sizes can vary. Thus, the apparatus 10 will be particularly applicable to cosmetic and other industries as well in addition to the paint industry. The lack of a bottom or top panel or bracket in the container holder mechanism 22*a*, 22*b* greatly facilitates the ability of the container holders 22*a*, 22*b* to accommodate containers of varying lengths. The inwardly extending fingers 32*a*, 32*b* greatly facilitate the accommodation of containers of varying diameters.

The fluid or flowable material to be mixed may also vary. Specifically, the material may be liquid or partially liquid, such as two immiscible liquids or a liquid suspension. The material may also include granular, solid or other materials in a slurry. The apparatus 10 is particularly suitable for mixing suspensions such as paint or other surface finishing mediums and cosmetic products, such as nail polish, hair dyes or skin products. The apparatus 10 is also suitable for agitating, mixing, blending, tumbling and washing operations.

While only certain embodiments have been set forth, alternative embodiments and various modifications will be apparent from the above description to those skilled in the art. These and other alternatives are considered equivalents and within the spirit and scope of the disclosure.

What is claimed is:

1. An apparatus for mixing flowable material contained in a container, the apparatus comprising:

a motor coupled to an arm, the motor imparting rotational movement to the arm about a first axis, the arm being L-shaped and comprising a lower horizontal leg that is coupled to the motor and a vertical leg coupled to a container holder, the vertical leg of the arm rotatively coupled to a first gear for imparting rotational movement to the first gear, the first gear enmeshed with a second stationary gear, the arm and first gear rotating about the second stationary gear, said second gear being coaxial with the first axis, the first gear coupled to a shaft for imparting rotational movement to the shaft, the shaft coupled to a third beveled gear for imparting rotational movement to the third beveled gear, the shaft and third beveled gear being coupled to the vertical leg of the arm and are rotated about the first axis with the arm, the third beveled gear enmeshed with a fourth beveled ring gear for imparting rotational movement to the fourth beveled gear, the fourth beveled gear coupled to and encircling the container holder for imparting rotational movement to the container holder about a second axis that is not parallel or perpendicular to the first axis, the container holder comprising a cylindrical sleeve with an open top and bottom, the cylindrical sleeve comprising an inner wall comprising a plurality of radially inwardly extending fingers for frictionally engaging the container.

2. The apparatus of claim 1 further comprising a bracket that surrounds the container holder and houses the fourth beveled gear, the fourth beveled gear supporting the container holder within the bracket while the fourth beveled gear and container holder rotate within the bracket about the second axis.

3. The apparatus of claim 1 wherein the container holder comprises an elastomer material.

4. The apparatus of claim 1 wherein the container holder comprises rubber.

5. The apparatus of claim 1 wherein the motor is coupled to the arm with a belt and pulley connection.

6. The apparatus of claim 1 wherein the motor is coupled to a drive shaft that is coupled to a first pulley, the first pulley coupled to a second pulley by a belt, the second pulley coupled to the arm for imparting rotational movement to the arm about the first axis.

7. The apparatus of claim 1 wherein the arm comprises a housing and the first gear, shaft, third beveled gear and fourth beveled gear are at least substantially contained within the housing of the arm.

8. An apparatus for mixing flowable material contained in containers of varying lengths and diameters, the apparatus comprising:

a motor coupled to an b-shaped arm, the motor imparting rotational movement to the arm about a first axis, the arm comprising (i) an L-shaped portion having a lower horizontal leg coupled to the motor and (ii) an upper horizontal leg coupled to said L-shaped portion and to a container holder for imparting rotational movement to the container holder about the first axis or an axis parallel to the first axis, the lower horizontal leg of the arm rotatively coupled to a first gear for imparting rotational movement to the first gear about the first axis, the first gear coupled to a shaft which is also rotatively coupled to the upper horizontal lea of the arm for imparting rotational movement to the shaft about the second axis, the shaft coupled to a third beveled gear for imparting rotational movement to the third beveled gear about the second axis, the third beveled gear being rotatively coupled to the upper horizontal lea of the arm, the third beveled gear enmeshed with a fourth beveled ring gear for imparting rotational movement to the fourth beveled gear about a third axis that is not parallel or perpendicular to either the first or second axes, the fourth beveled ring gear coupled to and encircling the container holder for imparting rotational movement to the container holder about the third axis, the container holder comprising a cylindrical sleeve with an open top and bottom, the cylindrical sleeve comprising an inner wall comprising a plurality of radially inwardly extending fingers for frictionally engaging containers of varying lengths and diameters.

9. The apparatus of claim 8 wherein the arm comprises a bracket that surrounds the container holder and houses the fourth beveled gear, the fourth beveled gear supporting the container holder within the bracket while the fourth beveled gear and container holder rotate within the bracket about the second axis.

10. The apparatus of claim 8 wherein the container holder comprises an elastomer material.

11. The apparatus of claim 8 wherein the container holder comprises rubber.

12. The apparatus of claim 8 wherein the motor is coupled to the arm with a belt and pulley connection.

13. The apparatus of claim 8 wherein the motor is coupled to a drive shaft that is coupled to a first pulley, the first pulley coupled to a second pulley by a belt, the second pulley coupled to the arm for imparting rotational movement to the arm about the first axis.

14. The apparatus of claim 8 wherein the arm comprises a housing and the first gear, shaft, third beveled gear and fourth beveled gear are at least substantially contained within the housing of the arm.

15. An apparatus for mixing flowable material contained in containers of varying lengths and diameters, the apparatus comprising:

a motor coupled to a drive shaft that is coupled to a first pulley, the first pulley coupled to a second pulley by a belt, the second pulley connected to an arm for imparting rotational movement of the arm about a first axis, the arm coupled to a container holder for imparting rotational movement to the container holder about the first axis or an axis parallel to the first axis, the arm coupled to a first gear for imparting rotational movement to the first gear about the first axis, the first gear enmeshed with a second stationary gear, the arm and first gear rotating about the second stationary gear causing additional rotation of the first gear about a second axis, said second axis being parallel with said first axis the first gear coupled to a shaft for imparting rotational movement to the shaft about the second axis, the shaft coupled to a third beveled gear for imparting rotational movement to the third beveled gear about the second axis, the first, second and third gears and the shaft all being rotatively coupled to and supported by the arm, the third beveled gear enmeshed with a fourth beveled ring gear for imparting rotational movement to the fourth beveled gear about a third axis that is not parallel or perpendicular to either the first or second axes, the fourth beveled gear coupled to and encircling the container holder for imparting rotational movement to the container holder about the third axis, the container holder comprising an elastomeric cylindrical sleeve with an open top and bottom, the cylindrical sleeve comprising an inner wall comprising a plurality of radially inwardly extending fingers for frictionally engaging containers of varying lengths and diameters, the arm comprising a housing and the first gear, shaft, third beveled gear and fourth beveled gear are at least substantially contained within the housing of the arm.

* * * * *

UNITED STATES PATENT AND TRADEMARK OFFICE

CERTIFICATE OF CORRECTION

PATENT NO. : 6,767,126 B2
DATED : July 27, 2004
INVENTOR(S) : William A. Miller

It is certified that error appears in the above-identified patent and that said Letters Patent is hereby corrected as shown below:

Column 5,
Line 10, please delete "an b-shaped arm," and replace with -- an arm, --.
Line 21, please insert -- the first gear enmeshed with a second stationary gear, the arm and first gear rotating about the second stationary gear causing additional rotation of the first gear about a second axis, --.
Lines 22 and 28, please delete "lea" and replace with -- leg --.

Column 6,
Line 26, please delete "with said first axis" and replace with -- with said first axis, --.

Signed and Sealed this

Fourteenth Day of December, 2004

JON W. DUDAS
*Director of the United States Patent and Trademark Office*